US007456367B2

(12) United States Patent
Goff et al.

(10) Patent No.: US 7,456,367 B2
(45) Date of Patent: Nov. 25, 2008

(54) POWER CRANK WINDOW SWITCH

(75) Inventors: David R. Goff, Macomb, MI (US); Joseph Wnuk, Westland, MI (US)

(73) Assignee: Omron Automotive Electronics, Inc., Novi, MI (US)

( * ) Notice: Subject to any disclaimer, the term of this patent is extended or adjusted under 35 U.S.C. 154(b) by 115 days.

(21) Appl. No.: 11/486,374

(22) Filed: Jul. 14, 2006

(65) Prior Publication Data

US 2007/0040526 A1 Feb. 22, 2007

Related U.S. Application Data

(60) Provisional application No. 60/700,358, filed on Jul. 19, 2005.

(51) Int. Cl.
*H01H 9/00* (2006.01)

(52) U.S. Cl. ..... 200/4

(58) Field of Classification Search ..... 49/141; 200/553–572, 18, 14, 61.39, 4
See application file for complete search history.

(56) References Cited

U.S. PATENT DOCUMENTS 2,805,579 A * 9/1957 Dehn ..... 200/557
4,553,656 A * 11/1985 Lense ..... 49/140
7,249,441 B2 * 7/2007 Hartle ..... 49/140

* cited by examiner

*Primary Examiner*—Edwin A. León
(74) *Attorney, Agent, or Firm*—Foley & Lardner LLP

(57) ABSTRACT

A controller for a power window actuator including a crank-handle body configured to look like a traditional automobile window crank handle, and an electronic control unit that includes at least one electrical switch positioned such that movement of the crank-handle body actuates the switch, wherein the electronic control unit is configured to generate a first electronic window control signal after the switch is actuated to at least one of a closed and an open position by movement of the crank-handle body to control a power window actuator to close/open a window.

29 Claims, 15 Drawing Sheets

| SELECTOR | | HANDLE POSITION | | | | OUTPUT | | | | | | | |
|---|---|---|---|---|---|---|---|---|---|---|---|---|---|
| A | B | C | D | E | F | LF-UP | LF-DWN | LF-AUTO | RF-UP | RF-DWN | RF-AUTO | INDICATOR A | INDICATOR B |
| 0 | 0 | 0 | 0 | 0 | 0 | 0 | 0 | 0 | 0 | 0 | 0 | 0 | 0 |
| | | 0 | 0 | 0 | 1 | 0 | 0 | 0 | 0 | 0 | 0 | 0 | 0 |
| | | 0 | 0 | 1 | 0 | 0 | 0 | 0 | 0 | 0 | 0 | 0 | 0 |
| | | 0 | 1 | 0 | 0 | 0 | 0 | 0 | 0 | 0 | 0 | 0 | 0 |
| | | 1 | 0 | 0 | 0 | 0 | 0 | 0 | 0 | 0 | 0 | 0 | 0 |
| 1 | 0 | 0 | 0 | 0 | 0 | 0 | 0 | 0 | 0 | 0 | 0 | 1 | 0 |
| | | 0 | 0 | 0 | 1 | 0 | 1 | 1 | 0 | 0 | 0 | 1 | 0 |
| | | 0 | 0 | 1 | 0 | 0 | 1 | 0 | 0 | 0 | 0 | 1 | 0 |
| | | 0 | 1 | 0 | 0 | 1 | 0 | 0 | 0 | 0 | 0 | 1 | 0 |
| | | 1 | 0 | 0 | 0 | 1 | 0 | 1 | 0 | 0 | 0 | 1 | 0 |
| 0 | 1 | 0 | 0 | 0 | 0 | 0 | 0 | 0 | 0 | 0 | 0 | 0 | 1 |
| | | 0 | 0 | 0 | 1 | 0 | 0 | 0 | 0 | 1 | 1 | 0 | 1 |
| | | 0 | 0 | 1 | 0 | 0 | 0 | 0 | 0 | 1 | 0 | 0 | 1 |
| | | 0 | 1 | 0 | 0 | 1 | 0 | 0 | 0 | 0 | 0 | 0 | 1 |
| | | 1 | 0 | 0 | 0 | 1 | 0 | 1 | 0 | 0 | 0 | 0 | 1 |
| 1 | 1 | 0 | 0 | 0 | 0 | 0 | 0 | 0 | 0 | 0 | 0 | 1 | 1 |
| | | 0 | 0 | 0 | 1 | 0 | 1 | 1 | 0 | 1 | 1 | 1 | 1 |
| | | 0 | 0 | 1 | 0 | 0 | 1 | 0 | 0 | 1 | 0 | 1 | 1 |
| | | 0 | 1 | 0 | 0 | 1 | 0 | 0 | 1 | 0 | 0 | 1 | 1 |
| | | 1 | 0 | 0 | 0 | 1 | 0 | 1 | 1 | 0 | 1 | 1 | 1 |

POWER CRANK WINDOW SWITCH

CROSS-REFERENCE TO RELATED PATENT APPLICATIONS

This application is an application claiming the benefit under 35 USC 119(e) to U.S. Provisional Application No. 60/700,358, filed Jul. 19, 2005, the contents of which are incorporated herein by reference in its entirety.

BACKGROUND OF THE INVENTION

Mechanical crank windows which were/are used to "roll up" and "roll down" automobile windows are well known. For many years, the overwhelming majority of automobiles produced in the world were produced with mechanical cranks. However by at least the late 1950s, and significantly accelerating into the 1960s and 1970s power window actuators began to replace mechanical cranks to roll up and roll down windows, to the point where, today, power window actuators are often standard features on automobiles produced in the United States. That is, instead of the utilizing the traditional hand crank, which may be seen by way of example in FIG. 1, to convert hand-inputted mechanical torque to linear movement of a car window, powered window actuators, typically electrically powered, are now commonly used to roll car windows up and down.

Power window actuators are typically controlled utilizing, for example, a push-pull, rocker, or toggle switches which are located, for example, on the armrest of the vehicle door, on a dashboard, or on a center console, etc. The power actuator feature relieved the user from having to input a relatively substantial amount of torque for a relatively long period of time (i.e., until the window was moved to the desired location) to move the window.

In the 1970s and continuing into the 1980s and 1990s, the power window, controlled utilizing toggle switches, was seen as stylish and trendy. That is, the power window utilizing its familiar toggle switches, which were moved by simply touching the toggle switch with a users fingertip, was seen as luxury.

SUMMARY OF THE INVENTION

In a first embodiment of the invention, there is a controller for a power window actuator, comprising, a crank-handle body, and an electronic control unit that includes at least one electrical switch positioned such that movement of the crank-handle body actuates the switch, wherein the electronic control unit is configured to generate a first electronic window control signal after the switch is actuated to at least one of a closed and an open position by movement of the crank-handle body.

In another embodiment of the invention, there is a controller for a power window of claim 1, further comprising a crank-handle body support mechanically linked to the crank-handle body, wherein the controller is configured to allow the crank-handle body to move with respect to the support, the movement with respect to the support providing the movement to actuate the at least one switch.

In another embodiment of the invention, the controller biases the crank-handle body to a neutral stationary position.

In another embodiment of the invention, the controller is configured to allow the crank-handle body to crank rotate with respect to the support. In another embodiment of the invention, the controller is configured to generate the first electronic window control signal to raise a power window upon crank rotation of the crank-handle body by a predetermined amount. In another embodiment of the invention, the controller is configured to generate the first electronic window control signal to raise the power window upon crank rotation of the crank-handle body by a first predetermined amount in a first predetermined direction, and, upon crank rotation of the crank-handle body in an opposite direction from the first predetermined direction by a second predetermined amount, at least one of (i) cease generating the first electronic window control signal, and (ii) generate a second electronic window control signal to stop the power window from raising.

In another embodiment, there is an automobile, comprising a power window actuator, and a controller as detailed herein, wherein the controller is in electrical communication with the power window actuator.

In another embodiment of the present invention, there is a method of controlling an automobile window by a user, comprising crank rotating a crank-handle body by gripping a crank handle grip in a palm of a hand of the user and applying a torque to the crank-handle body to actuate an electrical switch, generating a first electronic window control signal after the switch is actuated to at least one of a closed and an open position by movement of the crank-handle body and directing the first electronic window control signal to a power window actuator to raise the automobile window.

DETAILED DESCRIPTION OF THE PREFERRED EMBODIMENTS

Figure 1:
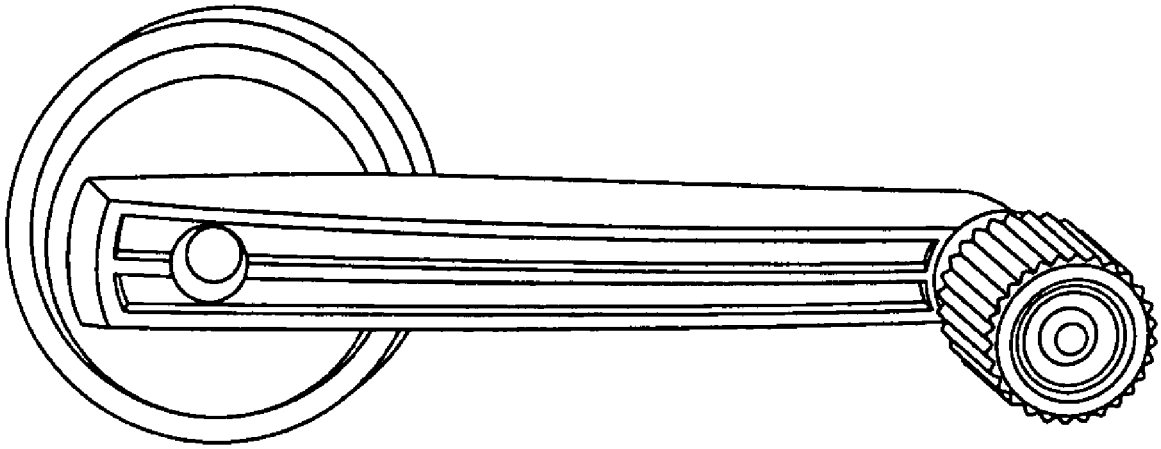
FIG. 1 PRIOR ART
FIG. 1 is an exemplary schematic of a crank handle according to the prior art.
Figure 2:
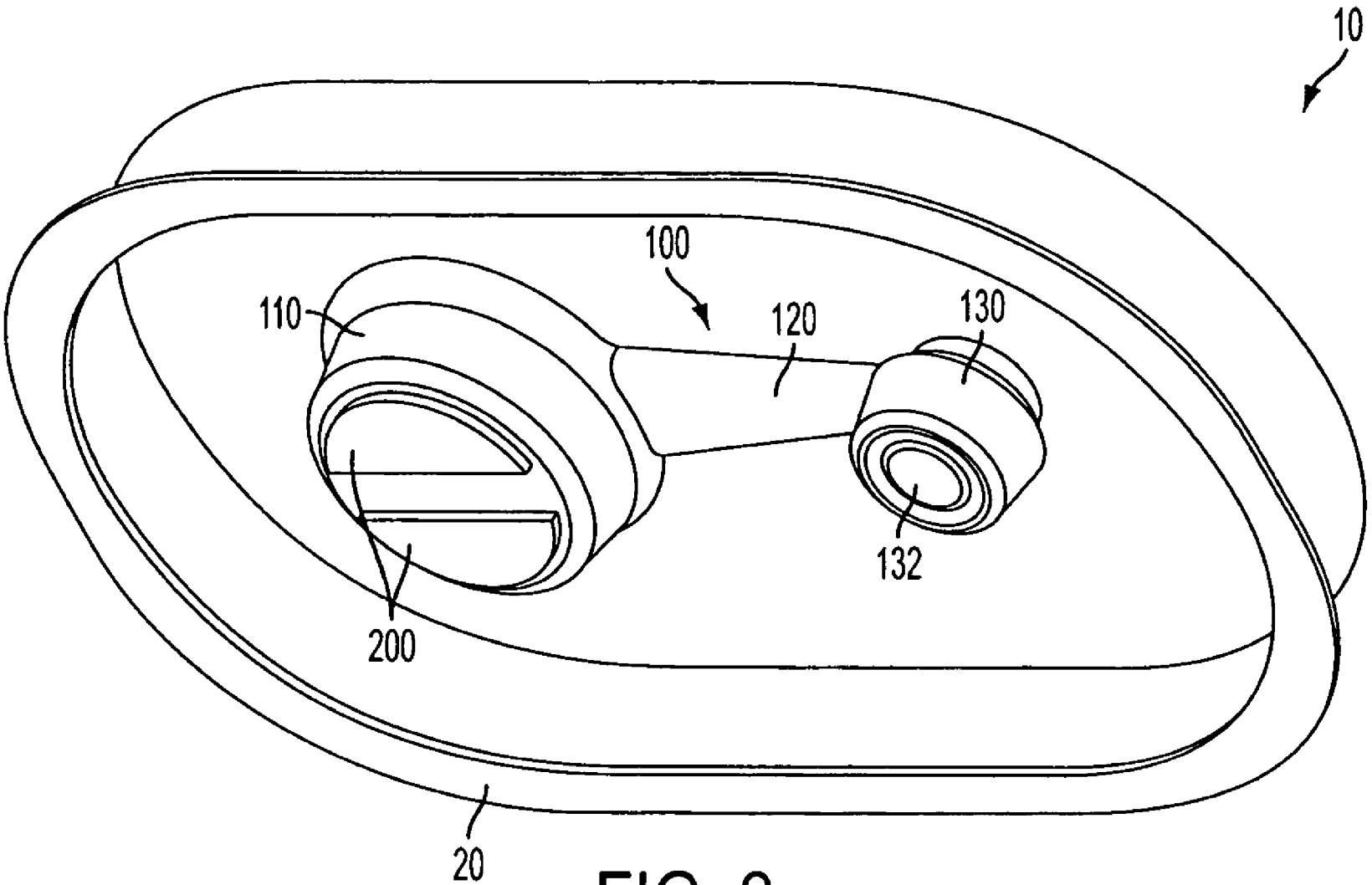
FIGS. 2 and 3*a* and 3*b* are exemplary schematics of a configuration of a controller according to an embodiment of the invention.

An embodiment of the present invention, the power crank window switch (or controller for a power window actuator), has the look and or the feel of the old style crank window handle (see, e.g., FIG. 1), while providing the features and conveniences of the more modern power window system. Referring now to FIGS. 2 and 3, in the first embodiment of the present invention, there is a controller 10 for a power window actuator comprising a crank handle body 100 and an electronic control unit 500, wherein the crank handle body 100 serves as an input device to control a power window actuator. By crank handle body (or crank-handle body), it is meant a crank handle that would look like or be similar to a traditional hand crank for a window, which one would expect to crank through grasping a part of the handle by a human hand, as opposed to a rocker switch or the like, which one would expect to actuate by simply applying a light force to the switch with one's finger tips. As may be seen, the crank handle body 100 is of a similar configuration to the crank handle depicted in FIG. 1. In some embodiments of the present invention, this crank handle body 100 may look substantially exactly the same as that depicted in FIG. 1, while in other embodiments, the crank handle body may be of different variations, while playing on the overall theme of utilizing a crank handle body that looks as if it would otherwise have the ability to mechanically actuate a window, while, in realty, functioning as an input device to control a power window actuator.

Still referring to FIGS. 2 and 3, in the first embodiment of the invention, the controller for a power winder actuator 10 is contained in a bezel 20 such that the crank handle body 100 is positioned inside the bezel in a recessed manner. This is discussed in greater detail below. In the first embodiment of the present invention, the electronic control unit includes electrical switches 510 that are positioned such that movement of the crank handle body 100 actuates the switches. In a first embodiment, actuation of a first switch (not shown in FIGS. 2 and 3) closes a circuit that enables a power window actuator to roll up the window, while actuation of a second switch (not shown in FIGS. 2 and 3) rolls down the window.

In an alternate embodiment of the invention, the electronic control unit 500 is configured to generate a first electronic window control signal after a switch is actuated by the crank handle body 100 to either a closed or an opened position or both. That is, according to embodiments of the present invention, instead of utilizing the crank handle to mechanically transfer an actuation force to the window, the crank handle is utilized as an input device to input user commands to an electronic control unit 500 which, in turn, generates a signal to control the window actuator to automatically power the window up/down, while giving the appearance of a crank operated window. That is, an embodiment of the present invention provides a "retro" look along with the functionality of a power window.

Figure 3B:
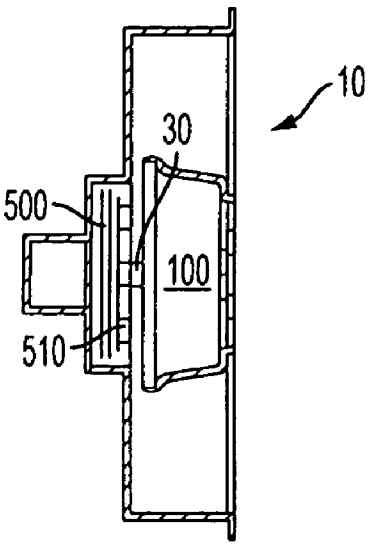
Figure 3A:
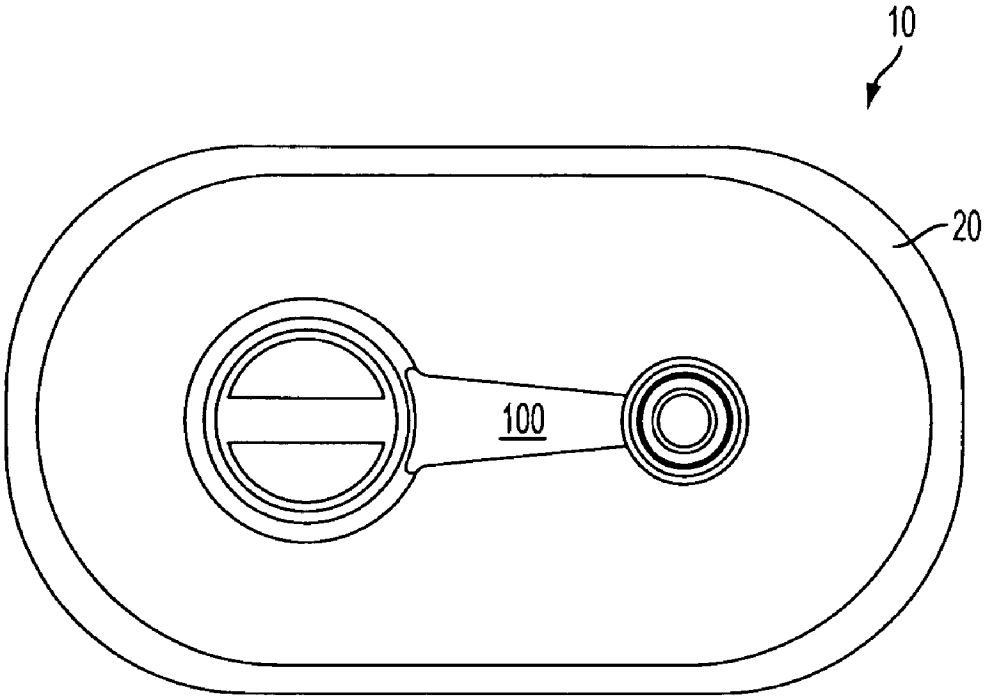

In a first embodiment of the present invention, the controller for a power window actuator comes as an integrated unit such as may be seen in FIG. 2 and FIGS. 3*a*-3*b*. That is, the crank handle body and the electronic control unit come as one pre-integrated unit. By way of example, the crank handle body 100 may be supported on a support mechanism 30, that may be, for example, a stud or a pedestal or a truss or cantilever beam or any structural component that may support the weight and forces applied to the crank handle body 100 that is mechanically linked to the crank handle body 100. The controller 10 may be configured to allow this crank handle body 100 to move with respect to the support 30. This movement, in some embodiments, provides the movement to actuate the at least one switch to generate the signal that may be sent to the power window actuator.

Figure 4A:
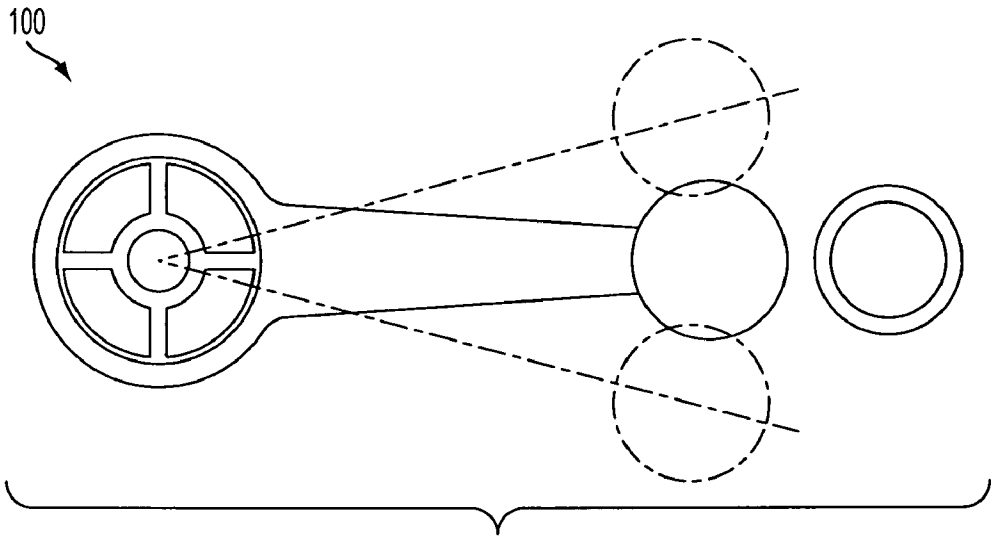
FIGS. 4*a*-4*b* schematically depicts movement of the crank handle depicted in FIG. 2.
Figure 4B:
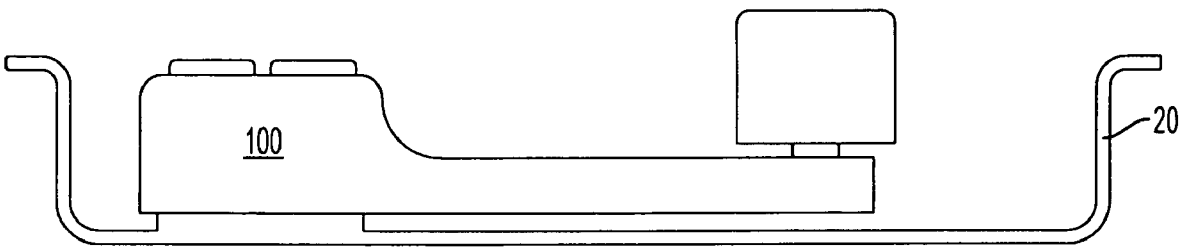

In a first embodiment of the present invention, the controller for a power window actuator 10 is configured to bias the crank handle body to a neutral stationary position. FIGS. 2, 3 and 4 depict such a neutral stationary position. By neutral stationary position, it is meant a position that the crank handle body will move to or stay at in the absence of an exterior force, such as one applied by a user, and/or in the absence of a catching device that prevents the handle from traveling to the neutral position, such as, for example, a detent. In some embodiments of the present invention, the controller 10 is configured to allow the crank handle body 100 to crank rotate with respect to the support 30. By "crank rotate," it is meant that the crank handle body may be moved in a manner similar to or the same as a typical crank handle body would be moved, such as the crank handle body depicted in FIG. 1. FIGS. 4*a*-4*b* depict an example of such movement.

However "crank rotate" also includes rotation that is similar to, but not the same as, the typical rotation as seen in FIGS. 4*a*-4*b*. In other embodiments of the present invention, some or all of the crank handle body "pivot rotates" with respect to the support 30, as may be seen in FIG. 6. (The ramifications of this will also be discussed below in greater detail.) In yet other embodiments of the present invention, the controller is configured such that the crank handle both pivot rotates and crank rotates.

Figure 7:
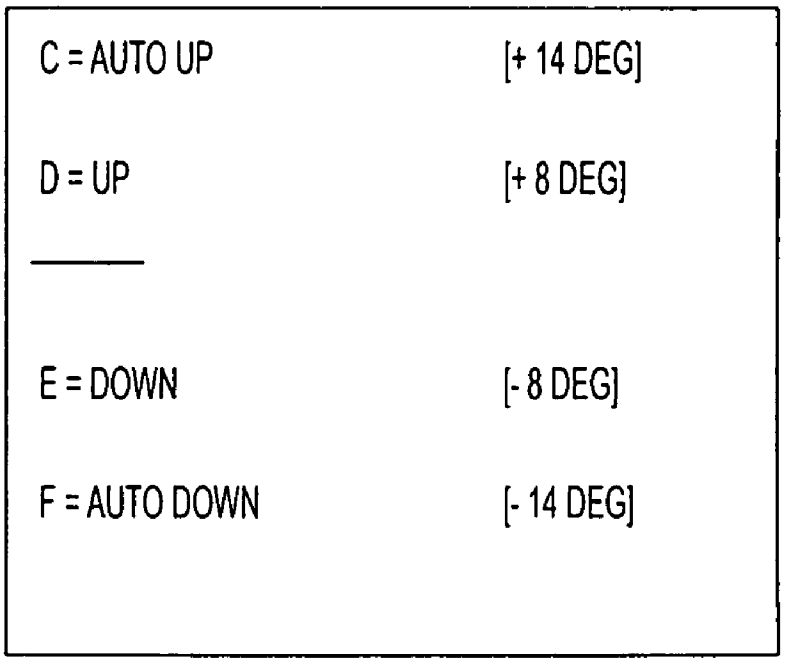
FIG. 7 schematically depicts movement of the crank handle depicted in FIG. 2.
Figure 7:
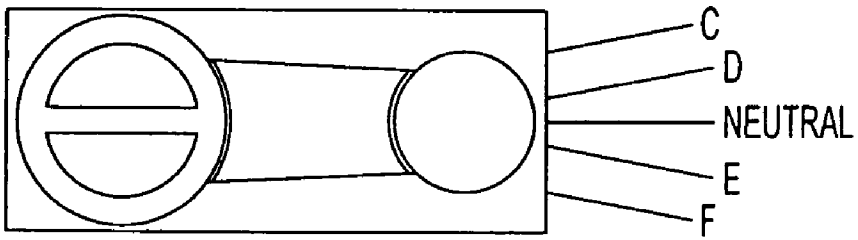

Referring now to FIG. 7, in an embodiment of the present invention, the controller 10 is configured to generate a first electronic window control signal to raise an automatic window upon crank rotation of the crank handle body 100 a pre-determined amount. By way of example only and not by way of limitation, if the crank handle body 10 is rotated in the counter clockwise direction 8° from its neutral position (to position "D"), a signal will be generated by the electronic control unit 500 to raise the power window. More specifically the electronic control unit 500 will output a single which will direct a power window actuator to move the window in an upward direction. In some embodiments of the present invention, the first electronic window control signal is outputted effectively continuously as long as the crank rotation handle is rotated 8° from the neutral position. However, in other embodiments of the present invention, the first electronic window control signal will be outputted non-continuously, and perhaps only once, and will be interpreted by the power window control actuator as an instruction to raise the window and keep raising the window until it receives a second signal countermanding the first signal and/or is "timed-out" and/or determines that the window is moved to its fullest extent. By way of example only, if after moving the crank handle to the 8° location in the counter clockwise direction, the user releases the crank handle 100 and the crank handle 100, which is biased to the neutral position, moves back to the neutral position/away from the 8° position, electronic control unit 500 may output a second signal to direct the actuator to stop raising the window. Alternatively, the electronic control unit 500 may simply cease outputting the signal to raise the window.

It will be understood by one of skill in the art that the reverse of the above discussion would be the case for movement of the crank handle in the clockwise direction to the 8° location (location "E" in FIG. 7), to lower the window.

In another embodiment of the present invention, the controller 10 is configured to generate an electronic window control signal that fully raises the automatic window (or, more accurately, directs/controls the power window actuator to fully raise the window) upon crank rotation of the crank handle body by another pre-determined amount, which is larger than the amount of crank handle movement to generate the first signal discussed above. By way of example, again referring to FIG. 7, if the crank handle body is rotated in the counter clockwise direction 14° (to position "C"), the electronic control unit 500 will output a signal directing the power window actuator to fully raise the automatic window, even if the handle is subsequently moved from position "C". However, in other embodiments of the present invention, the electronic control unit 500 outputs a signal that is quite similar to the signal discussed above, to raise the window except that it outputs the signal for a sufficient period of time (e.g., continuously) to have the power window actuator fully raise the automatic window.

Again, as would be appreciated by one of skill in the art, the reverse of the above discussion is the case for moving the window in the downward position. By way of example moving the crank handle body in a clockwise direction 14° (position F) will result in the power window actuator fully lowering the window.

As would be appreciated from the above, any signal or other means of directing a power window actuator to move a power window as desired by a user based on input of the user into the controller 10 through movement of the crank handle body 100 according to the present invention may be used to practice the invention. Thus, embodiments of the present invention may be practiced with a variety of electronic control signals/systems, whether based on the length of time that a signal is generated, the generation of multiple signals at one time, a particular encoded signal, a combination of these, etc., as long as the controller 10 is configured to control a power window actuator on the basis of a user movement of the crank handle body 100. Again, some embodiments of the present invention the invention are practiced by converting a mechanical movement of a crank handle body having a configuration the same as or similar to that depicted in FIG. 1, into an electronic signal which may be used to control the direction of a window. In some embodiments, switches are used to open/close circuits, to control the power actuator.

In some embodiments of the present invention, there are embodiments where a controller 10 according to the present invention may entirely replace the standard toggle switch controller which may be present on current car designs. In one embodiment, toggle switches are replaced with the controller 10 according to the present invention, the controller 10 being connected to the leads of the power window system that were formally connected to the toggle switch. That is, the controller 10 may include logic and/or signal generation capabilities to replace the signals that are generated by a current power window switch assembly. Thus, some embodiments of the present invention may be implemented to "retrofit" existing vehicles/vehicle designs/power window system designs by simply replacing current user interface components with controller 10.

Figure 8:
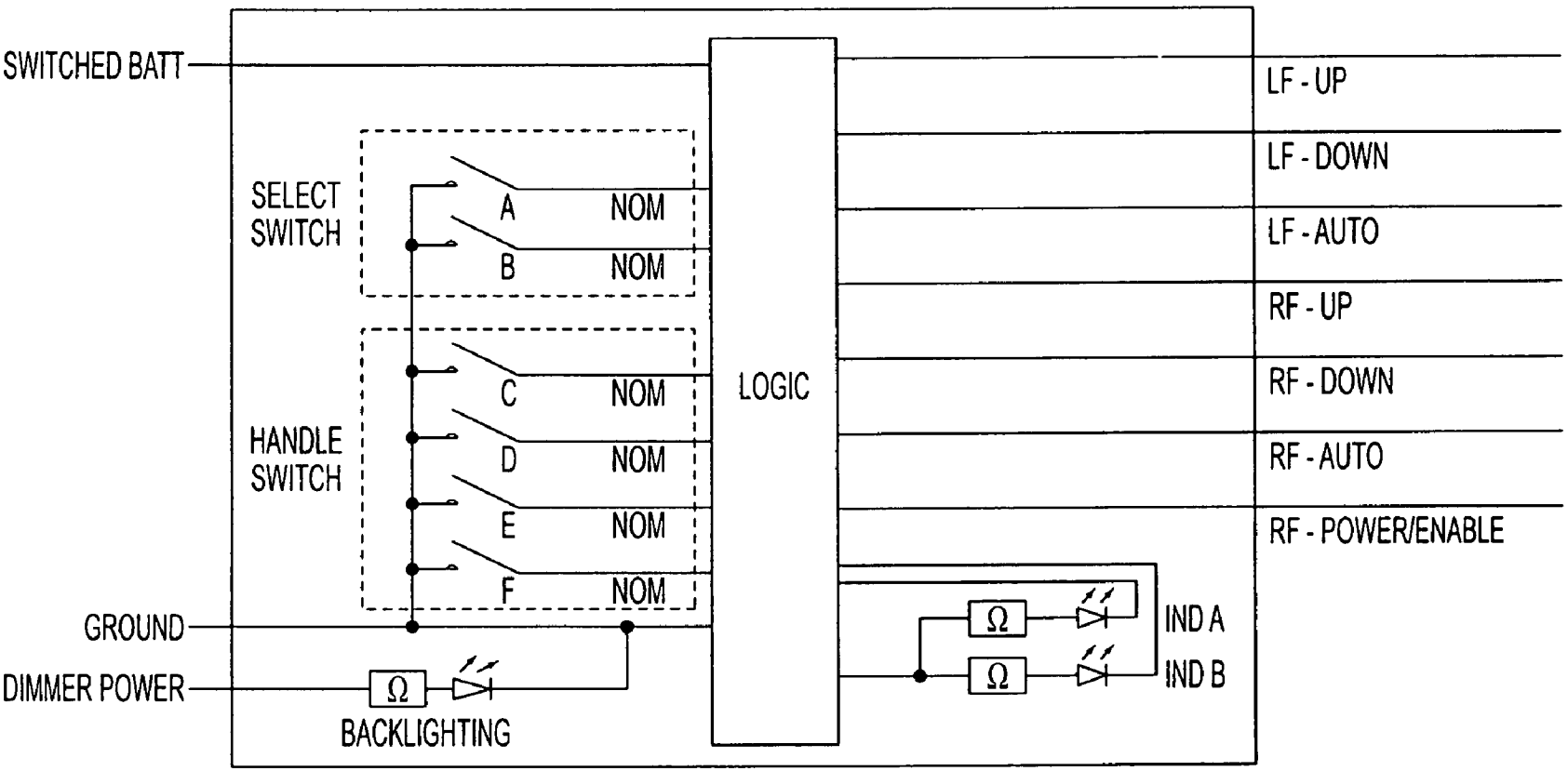
FIG. 8 schematically depicts a circuit for a driver's side controller according to an embodiment of the present invention.
Figure 9:
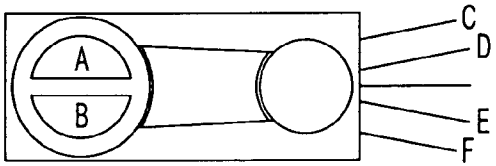
FIG. 9 is a logic chart for the circuit depicted in FIG. 8.

FIG. 8 schematically depicts a simplified circuit diagram that may be used to implement an embodiment of the present invention. FIG. 9 provides an exemplary logic table that may be used to implement some embodiments of the present invention.

The schematic of FIG. 8 is directed towards a circuit for use in a driver side controller 10 according to one embodiment of the present invention. As, may be seen, the circuit includes selector switches A and B. In this embodiment, a controller 10, which may be used as a driver's side controller, includes switches that may be used to control a particular window from amongst a plurality of windows to be raised/lowered according to the driver's command. That is, the embodiment depicted in FIG. 8 permits a driver of an automobile to control not only the driver's side window, but also other windows in the vehicle (in the case of a two-door vehicle, where only the driver's window and the passenger's window are powered). The controller 10 need only, in some embodiments, be able to direct output signals to either the driver's side window, the passenger's side window, or both. In other embodiments, the controller 10 outputs a signal that is received by all window actuators, but the signal is configured such that it is unique to a certain side actuator and operates only that actuator.

FIG. 9 presents an example of a logic table for controlling a window according to an embodiment of the present invention. As may be seen, when neither the A or B switches on the selector have been closed, and when the handle position is not at any of the locations C-F, all output is "0," and no window moves. However, if the A switch is closed, and the handle position is at, for example, the D position, a "1" will be outputted from both the A switch and the D location, thus corresponding to an instruction to raise the left front window as long as the handle is at the D position, and to light up the indicator for the A switch. If the handle is then moved to the C location, a "1" will be outputted for the C location instead of the D location, and the window will automatically raise until it is fully closed.

Figure 10:
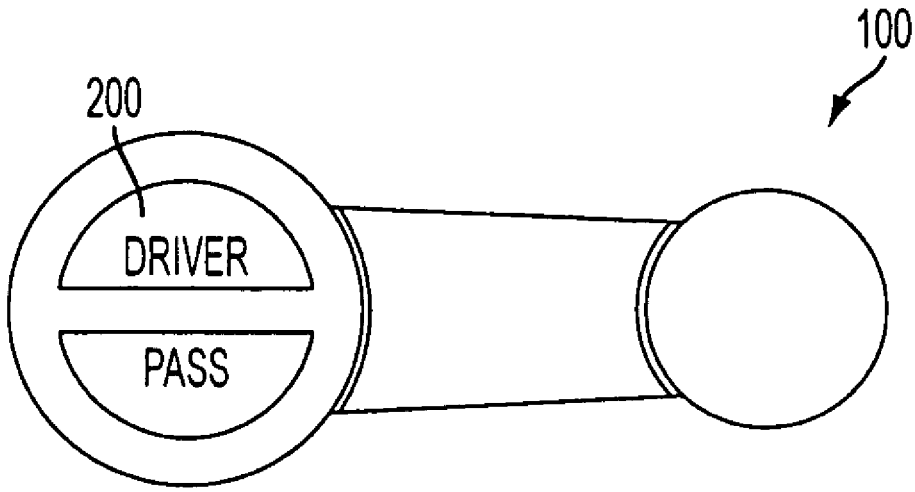
FIGS. 10 and 11 and 12 schematically depict crank handles with touch buttons according to other embodiments of the invention.
Figure 11:
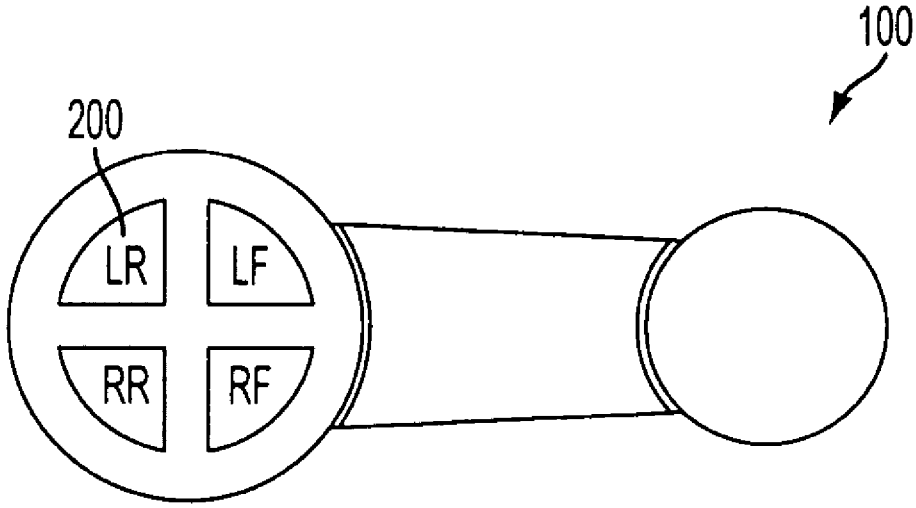

As just detailed, the controller 10 according to some embodiments, such as the driver's side embodiments, may allow the driver to select different windows to be controlled. Accordingly, in some embodiments of the present invention, the driver's side controller 10 also includes a window selector that permits the driver to select between windows. Referring now to FIGS. 10 and 11, an embodiment of the present invention includes a window selector 200, also depicted in FIGS. 2 and 3, that is configured to permit a user to input a control command by touching a touch switch mounted on the crank handle body, in order to control which window in the vehicle the user desires to control. In the first embodiment of the present invention, the window selector includes a touch button labeled "driver" and a touch button labeled "passenger."

Referring now to FIG. 11, a second embodiment is provided, wherein the window selector 200 includes four buttons labeled as shown. One button for the left front window; one button for the right front window; one button for the left rear window and one button for the right rear window.

Figure 5A:
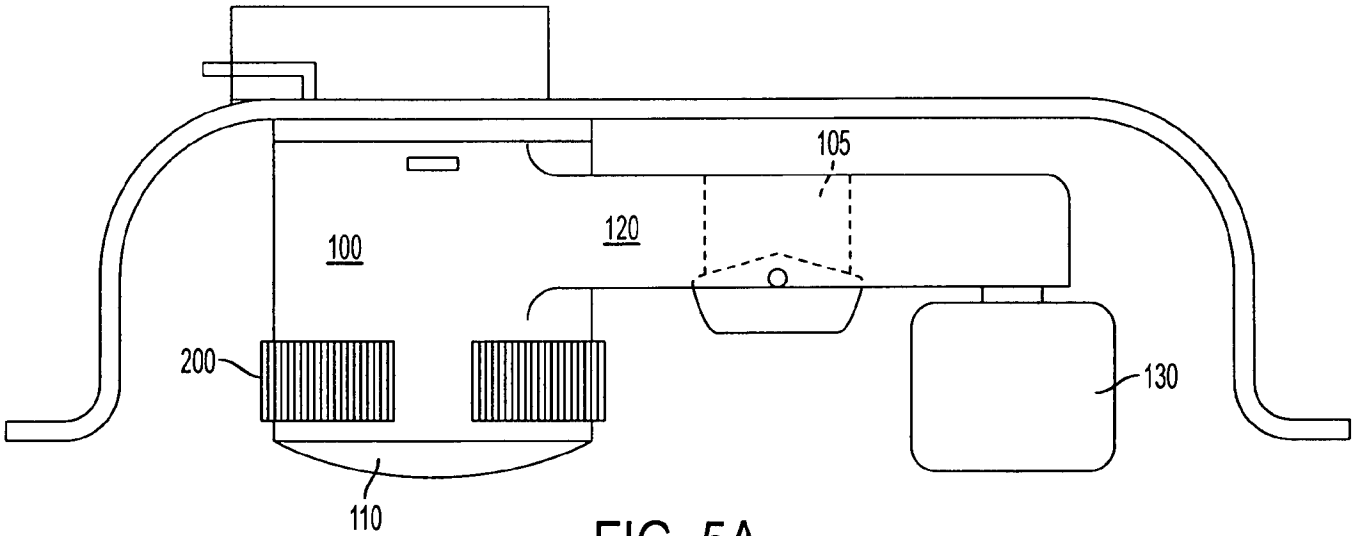
FIGS. 5*a*-5*b* are an exemplary schematic of a configuration of a controller according to another embodiment of the invention.
Figure 5B:
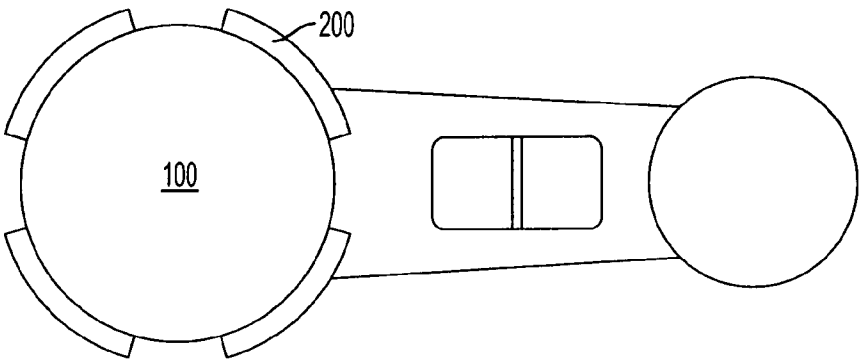

While the touch buttons of the window selector 200 are located within a circumference of a portion of the crank handle body 100 (e.g., the main body 110) in the embodiment depicted in FIGS. 10 and 11, in other embodiments, the touch buttons are arrayed about the circumference of a portion of the crank handle 100, as is exemplary depicted in FIGS. 5*a*-5*b*, where the buttons 200 are arrayed about main body 110). In other embodiments of the present invention, the touch buttons may be located elsewhere. Indeed, embodiments of the present invention include positioning the window selector 200 at any location that will enable a user to control a desired window.

In some embodiments of the present invention, the window selector is configured to at least one of direct an electronic window control signal to a particular power window actuation device from amongst a plurality of power window actuation devices. In other embodiments, the window selector 200 is configured to influence or to generate a specific electronic window control signal so that the signal actuates a single desired power window actuation device from amongst a plurality of devices. Any type of signal or signal generated arrangement, combination of signals, variations of signals etc., that may be outputted from the controller 10 may be utilized to practice embodiments of the present invention, as long as such permits the user to control a particular window from a plurality of windows. Indeed, any architecture may be utilized as long as such architecture permits the user to control a particular window.

As detailed above, in some embodiments of the present invention, there are two touch switches while in other embodiments there may be four touch switches. In yet other embodiments, there may be more or less touch switches, such as in some embodiments, where it is desired to control a rear window perhaps, a fifth button may be added.

Referring back to FIG. 8, some embodiments include such switches that are configured to at least one of open and close respective circuits when the user touches the respective touch switch. In the embodiment depicted in FIGS. 8 and 9, various switches (closed/opened upon movement of the crank handle body) are used to input information into a logic section, which outputs a signal according to the desired input. However, in other embodiments, it may be practical to simply hardwire these various switches directly to actuation units.

In other embodiments of the present invention, the controller 10 is configured such that a user may simultaneously control action of a plurality of window actuation devices through a single movement of the crank handle body. By way of example, if a user touches the driver touch button and the passenger touch button at the same time or within a relatively close pre-determined period of time, say, for example, half a second, movement of the crank handle body will control both windows. In yet other embodiments of the present invention, touching one button repeatedly may result in control of all windows simultaneously. In other embodiments, there is a time-out period, after which time the system returns control to a default position (e.g., default control of a driver's side controller 10 would be to control the driver's side window and/or to off, default of a passenger window would be to off, etc.)

Figure 6:
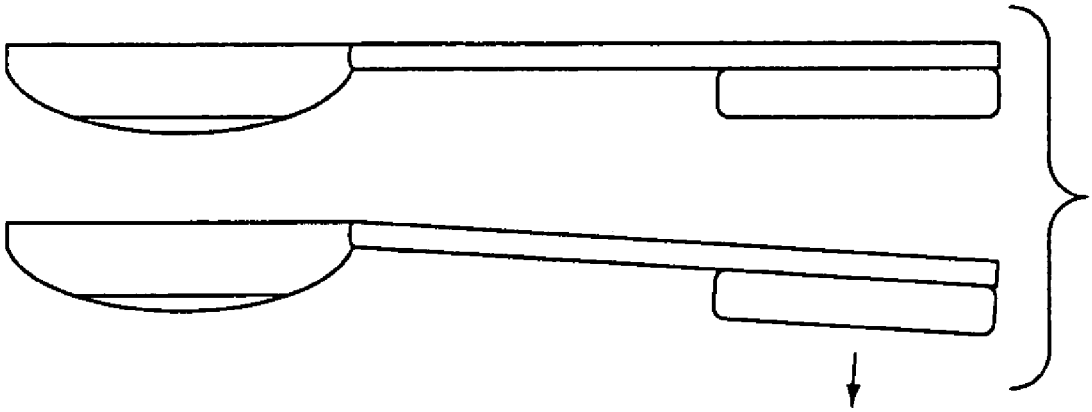
FIG. 6 schematically depicts movement of the crank handle according to another embodiment of the present invention.

Referring back to FIG. 6, in some embodiments of the present invention the controller 10 is configured to generate electronic window control signals to raise/lower an automatic window upon "pivot" rotation of at least a portion of the crank handle body 100. Pivoting the crank arm in one direction as shown in FIG. 6, may result in a window being raised while pivoting the crank handle arm in an opposite direction (not shown) may result in the window being lowered. The implementations of this embodiment may be the same as or similar to those detailed above with respect to movement of the crank handle body, along with control logic/control circuits utilized to practice the invention. For example, pivot movement of the crank handle arm 8° away from a neutral position may output a signal to raise the window only while the crank handle is located at that 8° position, whereas if the crank handle arm is pivoted to a 14° position away from the neutral position, the controller 10 will output a signal to automatically raise the window to its highest position.

Figure 12:
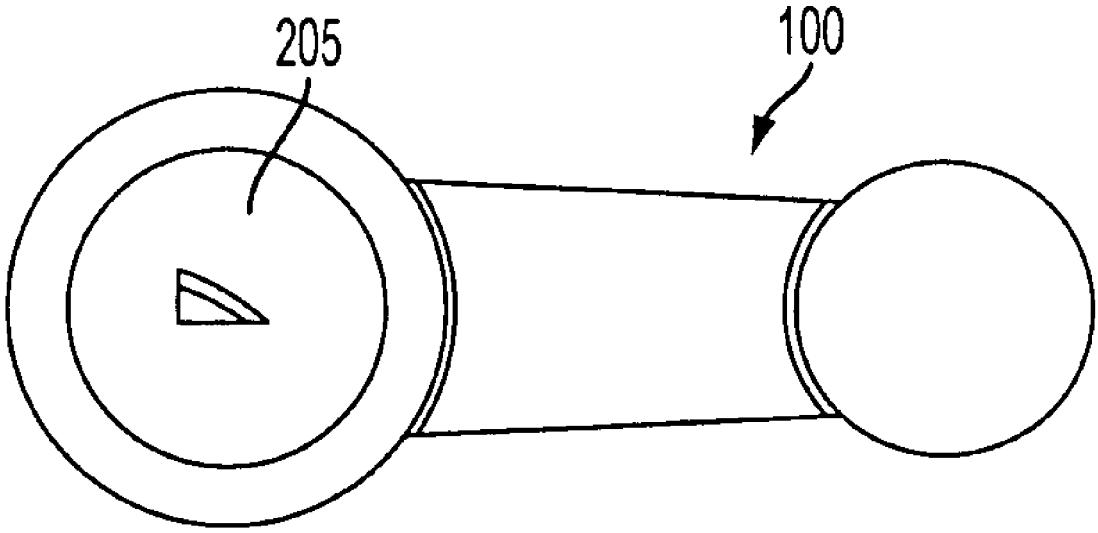

Referring now to FIG. 12, an embodiment of the present invention includes a window control enablement touch switch 205. In this embodiment, the window control enablement touch switch 205 is mounted on the crank handle body. Embodiments of crank handle bodies such as that depicted in FIG. 12 may be utilized, for example, for a passenger side window controller. The user may touch the touch button 205 to enable control of the window through the crank handle. That is prior, to touching the touch button 205, the rotation of the crank handle/movement of the crank handle may not result in movement of the window. However, after the touch button 205 is touched, movement of the crank handle may result in window movement as detailed herein. In some embodiments of the present invention, the controller 10 includes a time out feature such that the movement of the crank handle body is only effective to raise or lower a window within a certain period of time after the button 205 is touched, after which said period of elapsed time being expired, the button 205 must be touched again to move the window. In other embodiments of the present invention, the button may be touched to enable window control through the crank handle body 100, and then the button may be then touched again to disable control to the crank handle body 100.

Figure 13A:
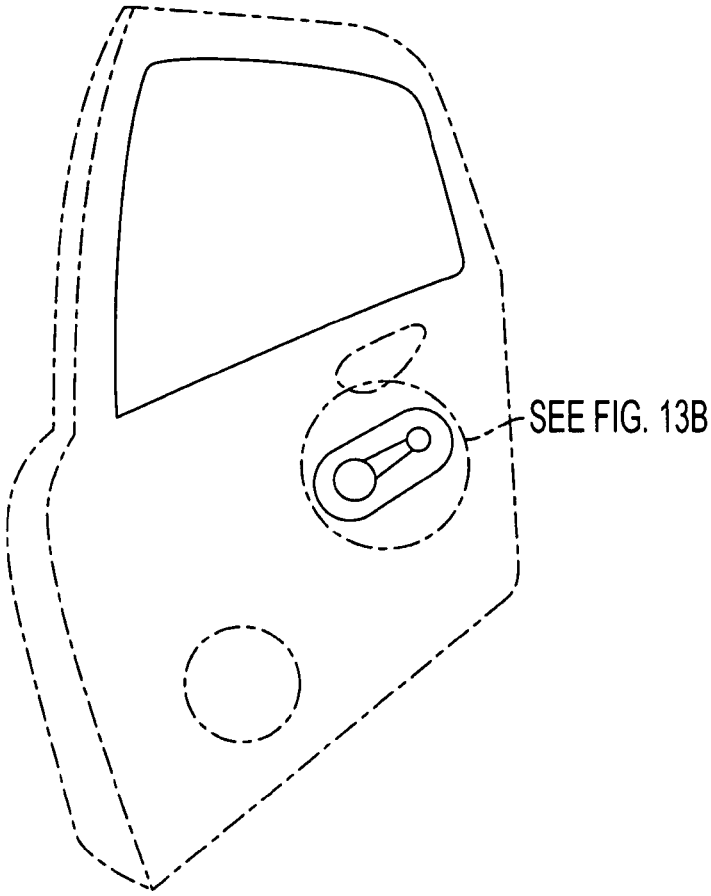
FIGS. 13A and 13B depict installations of a controller according to the present invention in an automobile door.
Figure 13B:
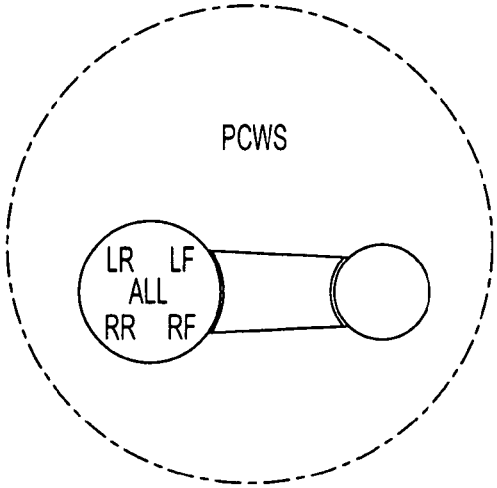

Referring again back to FIGS. 2 and 3, in an embodiment of the present invention the control handle body 100 is positioned inside a bezel that substantially encompasses the crank handle body 100. In some embodiments of the present invention, this bezel 30 may be utilized to provide ease of installation into a door with a power window, as may be seen by way of example in FIGS. 13A and 13B. That is, referring to above embodiments where the controller 10 is configured in a self-contained integrated device, the bezel 30 may be configured to "snap" in or otherwise easily attach to an opening in a door. That is, the bezel may provide support for the controller 10 in the door. In other embodiments of the present invention, some or all of the crank handle body may be located proud (raised from) of the contours of the door, whereas in the invention depicted herein, utilizing the bezel 30, if the bezel 30 is mounted such that the top exterior surface is substantially flush with the contours of the door, the crank handle body 100 would not be proud of the contours of the door. Indeed, in some embodiments, the bezel 30 "hides" the handle, to some extent. In some embodiments, incorporation of the controller 10 according to the present invention frees up armrest area on a car door, as the controller 10 may be mounted on a location other than the armrest, such as, for example, above the armrest on an interior door panel, in front of the armrest, beneath the armrest, etc. This is especially the case when the controller 10 is entirely or substantially entirely flush with the interior surface of the door.

In some embodiments of the present invention, the controller 100 is configured to apply backlighting and/or indicators to the crank handle body and/or apply backlighting to the window selector 200. FIG. 8 provides a schematic diagram that addresses such backlighting. In some embodiments of the invention, the backlighting may be provided for a particular touch switch that has been activated by the user. By way of example, if the front right window is desired to be controlled utilizing the controller 10 and the user presses the button for the front right window, only that button B in FIG. 9 or RF in FIG. 11 will be backlit; the remaining buttons will not be backlit. However, in other embodiments, the selected button may simply be backlit to be brighter to allow the user to differentiate between which button is selected, but also permit the user to be able to see, at night, the other switches. In yet other embodiments of the present invention, the backlighting of the controller 10 may be dim such that if the interior night lighting used for driving (e.g., the dashboard lights) are on but dimmed a certain amount, that dimming will also be used to control the brightness of the backlighting of the controller 10 according to the present invention.

As described above, some embodiments of the present invention include a crank handle body 100 or a portion of the crank handle body, such as the crank handle arm 120 (see, e.g., FIG. 2 in view of FIG. 6) that may be pivot rotated. Pivot rotation may be utilized to control other switching functions as desired. By way of example, the crank rotation may be utilized to control the direction and amount of movement of the windows, and the pivot movement may be used to input which particular window will be controlled by the crank rotation (e.g., pivot rotation to the left being the left window, pivot rotation to the right being the right window, etc.) However, in other embodiments, pivot rotation may be utilized to activate other functions, as desired as well.

By utilizing the selector switch 200 (see, e.g., FIG. 2) as detailed above, in embodiments where the selector switches may be utilized to operate a particular window, the need for a lockout switch may be eliminated. In some embodiments of the present invention, hard stops are present to prevent over rotation/over pivoting of the crank handle body 100. For example, hard stops may be located at an angle of 14° in the clockwise direction and 14° in the counter clockwise direction from the neutral position of the crank handle body 100. This may prevent, or at least reduce, the likelihood that the crank handle may be over torqued. In yet other embodiments of the present invention, detents are located at various locations along the path of travel of the crank handle body. By way of example, at the 8° mark described above, a detent may be located such that movement of the crank handle to that 8° will hold the handle in place to cancel the bias of the crank handle body to move back to the neutral position or substantially reduce that bias such that the user need apply less force or no force to keep the window going up but still be under the manual control of the user. In some embodiment, detents are used to simply provide the user with a tactile feel of where the handle is located. In other embodiment, a "click" may accompany the detent, to give the user an audio sense of where the crank handle is located.

Some embodiments of the present invention are constructed of plastic, PCB, etc.

As detailed above, some embodiments may be configured such that they are fully integrated and may be installed as a unit onto a vehicle. In this regard, a 0.64 millimeter box terminal connector may be included with the controller 10 to make electrical hookup conducive to a door of a vehicle.

In some embodiments of the present invention, the look of the controller 10 in general and the crank handle 100 in particular may be customized. For example, surface finishes in different colors, color finishes with chrome, wood grain or molded film accents may be utilized. Still further, corporate logos, special monograms, etc., on knob surfaces or other surfaces of the controller 10 may be utilized with embodiments of the invention. For example, an emblem may be positioned at location 132 in FIG. 2, as may be seen. In an embodiment of the present invention, a left hand unit and a right hand are of a design to be interchangeable. That is, the controller 10 for a left hand door is configured to be interchangeable with that of a right hand door, and vice-a-versa. By way of example, the controller 10 may include logic, or be otherwise configured such that the controller self-determines what side of the vehicle it is on. In yet other embodiments of the present invention, the vehicle is configured to determine where the controls are coming. In other embodiments, an installer of the controller 10 configures the controller 10 for the particular door by, for example, reversing a connector, or throwing a switch on the door-side of the bezel that switches from a right-side door to a left-side door.

Figure 14:
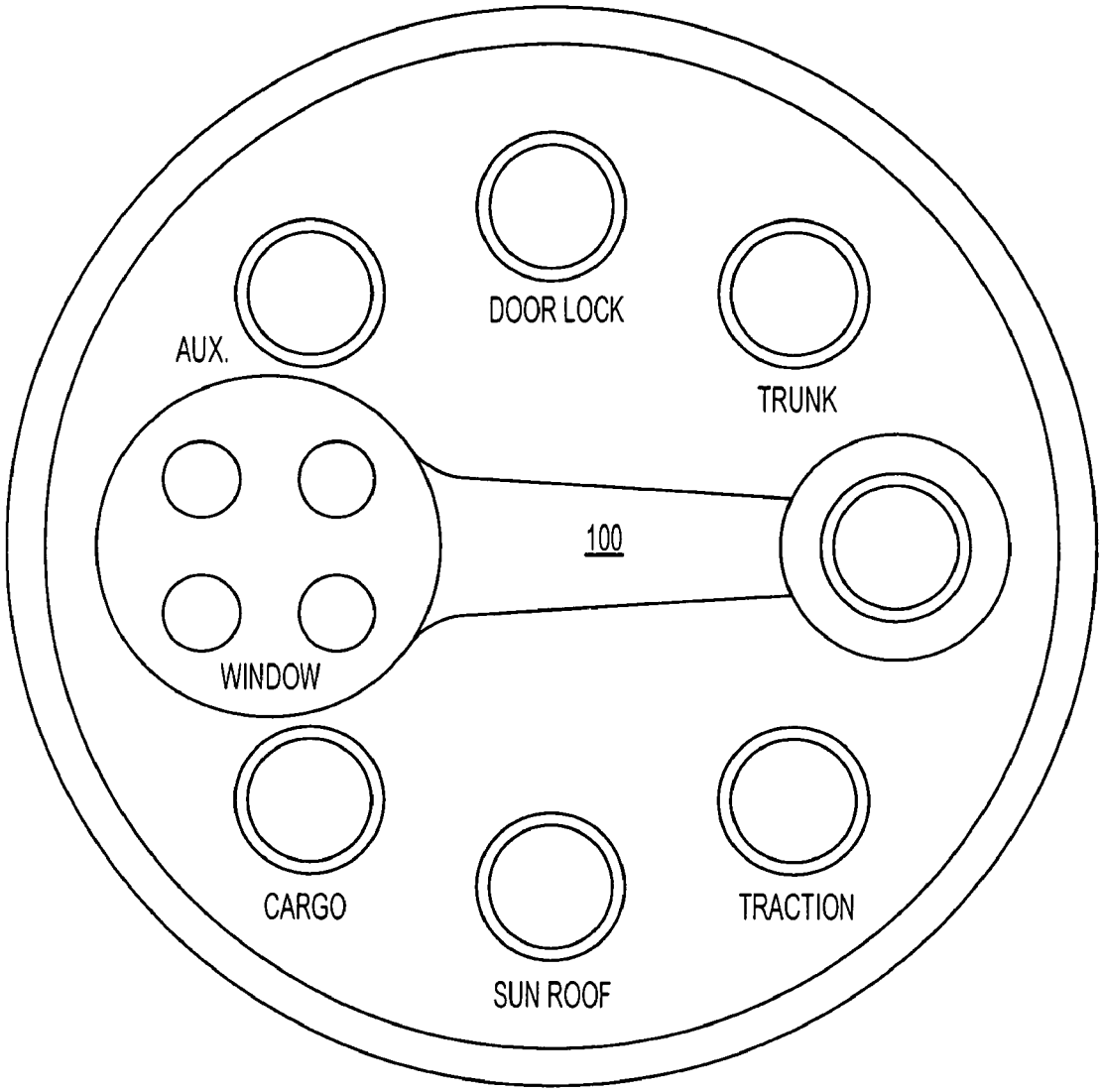
FIG. 14 depicts a schematic of another embodiment of the present invention.
Figure 15A:
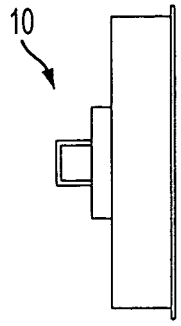
FIGS. 15*a*-15*e* depicts a partial design drawing of the controller according to an embodiment of the invention.
Figure 15B:
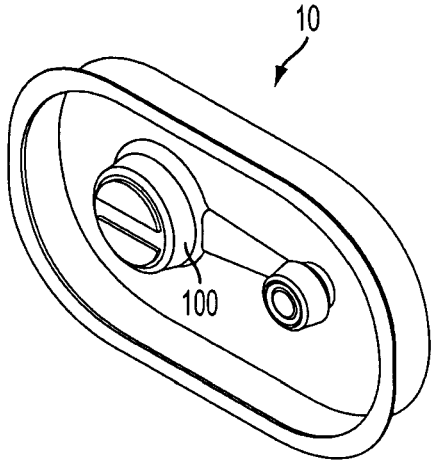
Figure 15C:
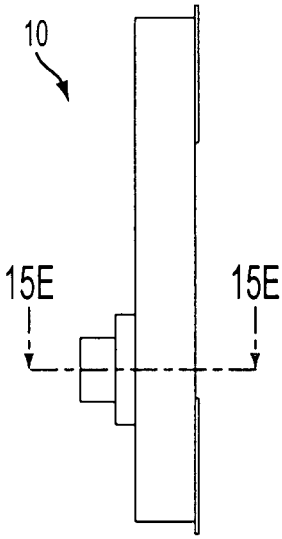
Figure 15D:
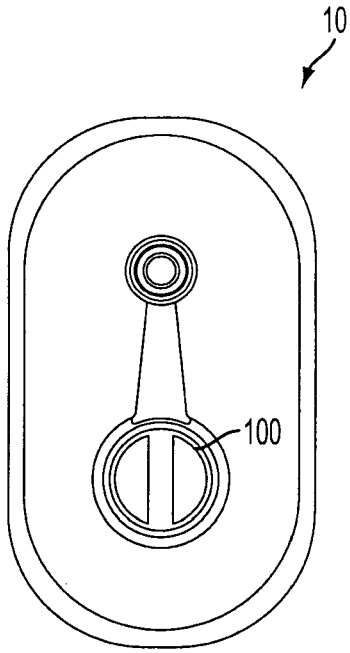
Figure 15E:
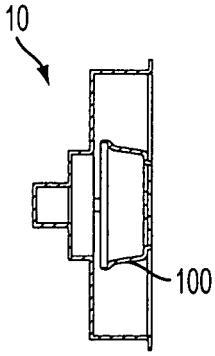
Figure 16A:
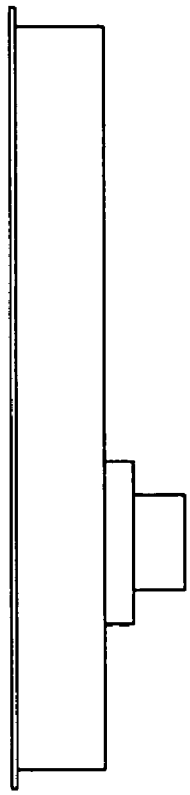
FIGS. 16*a*-16*b* depicts a partial design drawing of the controller according to an embodiment of the invention.
Figure 16B:
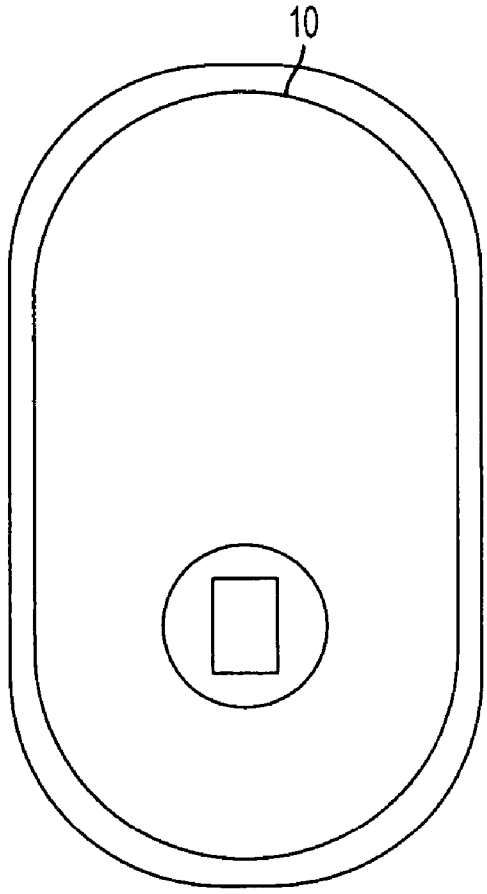

FIG. 14 depicts another embodiment of the present invention where the crank handle body 100 is used to control a variety of components on the vehicle. Such an embodiment might be mounted on, for example, the center consol. That is, instead of controlling a window, the crank handle body is used to control other components of the car such, as a door lock, a trunk opening, sunroof, traction control, etc. In such an embodiment, the look of the older mechanical crank handles is obtained while the functionality of a modern switch controlled or button controlled system is obtained. Such embodiments might be applied by placing an integrated pod in the center console.

FIGS. 15*a*-16*b* present additional embodiments of the present invention.

In some embodiments of the present invention, a selection of window control regime is implemented such that a default value for selectors is off on ignition cycling. In such embodiments the need for lockout switch or push pull knobs is reduced/eliminated. As detailed, backlighting may be utilized in some embodiments of the present invention implemented by LEDs, whereas in other embodiments light rings are utilized. In some embodiments, the push switches are non-latching push button switches. In other embodiments, the switches may latch. In yet other embodiments they may be virtual switches such as switches that are activated through proximity sensing of the hand/body of the user.

In some embodiments of the present invention, the controller 10 is utilized with a proximity sensor that controls the lighting/back lighting of the controller 10 based on the proximity of a user's hand or other body part to the controller 10. By way of example, such a controller might be in accordance with U.S. Pat. No. 6,774,505, the contents of which are incorporated herein in its entirety. By way of example, lighting associated with the controller 10 might brighten from a dimmed setting upon sensing that a user's hand is within 2 inches from the controller 10, or lighting might be turned on from the off setting, etc.

Given the disclosure of the present invention, one versed in the art would appreciate that there are other embodiments and modifications within the scope and spirit of the present invention. Accordingly, all modifications attainable by one versed in the art from the present disclosure within the scope and spirit of the present invention are to be included as further embodiments of the present invention.

What is claimed is:

1. A controller for a power window actuator, comprising:

a crank-handle body;

an electronic control unit that includes at least one electrical switch positioned such that movement of the crank-handle body actuates the switch, wherein the electronic control unit is configured to generate a first electronic window control signal after the switch is actuated to at least one of a closed and an open position by movement of the crank-handle body; and a crank-handle body support mechanically linked to the crank-handle body, wherein the controller is configured to allow the crank-handle body to move with respect to the support, the movement with respect to the support providing the movement to actuate the at least one switch, wherein the controller biases the crank-handle body to a neutral stationary position, the controller is configured to allow the crank-handle body to crank rotate with respect to the support, the controller is configured to generate the first electronic window control signal to raise the power window upon crank rotation of the crank-handle body by a first predetermined amount in a first predetermined direction, and, upon crank rotation of the crank-handle body in an opposite direction from the first predetermined direction by a second predetermined amount, at least one of (i) cease generating the first electronic window control signal, and (ii) generate a second electronic window control signal to stop the power window from raising, and the controller is configured to at least one of:

(i) generate a third electronic window control signal to fully raise the power window upon crank rotation of the crank-handle body by a third predetermined amount in excess of the first predetermined amount in the first predetermined direction; and (ii) generate the first electronic window control signal a sufficient time to fully raise the power window upon crank rotation of the crank-handle body by the third predetermined amount in excess of the first predetermined amount in the first predetermined direction.

2. The controller of claim 1, wherein the controller is configured to generate the first electronic window control signal to raise a power window upon crank rotation of the crank-handle body by a predetermined amount.

3. The controller of claim 1 wherein the controller is configured to generate the first electronic window control signal to raise the power window upon pivot rotation of at least a portion of the crank-handle body by a first predetermined amount in a first predetermined direction, and, upon pivot rotation of the crank-handle body in an opposite direction from the first predetermined direction by a second predetermined amount, at least one of (i) cease generating the first electronic window control signal, and (ii) generate a second electronic window control signal to stop the power window from raising.

4. The controller of claim 1, wherein the crank handle body includes a main body from which a crank arm extends, and a crank handle grip located on the crank arm substantially opposite the crank body and extending substantially normal away from the crank handle, wherein the crank body is volumetrically larger than the crank handle, and wherein the axis of rotation of the crank handle body with respect to crank rotation bisects the main body.

5. An automobile, comprising:

a power window actuator; and a controller according to claim 1, wherein the controller is in electrical communication with the power window actuator.

6. A controller for a power window actuator, comprising:

a crank-handle body;

an electronic control unit that includes at least one electrical switch positioned such that movement of the crank-handle body actuates the switch, wherein the electronic control unit is configured to generate a first electronic window control signal after the switch is actuated to at least one of a closed and an open position by movement of the crank-handle body; and a crank-handle body support mechanically linked to the crank-handle body, wherein the controller is configured to allow the crank-handle body to move with respect to the support, the movement with respect to the support providing the movement to actuate the at least one switch, wherein the controller biases the crank-handle body to a neutral stationary position, the controller is configured to allow the crank-handle body to crank rotate with respect to the support, the controller is configured to generate the first electronic window control signal to raise the power window upon crank rotation of the crank-handle body by a first predetermined amount in a first predetermined direction, and, upon crank rotation of the crank-handle body in an opposite direction from the first predetermined direction by a second predetermined amount, at least one of (i) cease generating the first electronic window control signal, and (ii) generate a second electronic window control signal to stop the power window from raising, and the controller is configured to generate a third electronic window control signal to lower the power window upon crank rotation of the crank-handle body by a third predetermined amount in a second predetermined direction opposite from the first predetermined direction, and, upon crank rotation of the crank-handle body in an opposite direction from the second predetermined direction by a fourth predetermined amount, at least one of (i) cease generating the third electronic window control signal, and (ii) generate a fourth electronic window control signal to stop the power window from lowering.

7. The controller of claim 6, wherein the controller is configured to allow at least a portion of the crank-handle body to pivot rotate with respect to the support.

8. The controller of claim 6, wherein the controller is configured to generate the first electronic window control signal to raise an power window upon pivot rotation of at least a portion of the crank-handle body by a predetermined amount.

9. The controller of claim 6, wherein the crank handle body includes a main body from which a crank arm extends, and a crank handle grip located on the crank arm substantially opposite the crank body and extending substantially normal away from the crank handle, wherein the crank body is volumetrically larger than the crank handle grip.

10. An automobile, comprising:

a power window actuator; and a controller according to claim 6, wherein the controller is in electrical communication with the power window actuator.

11. The controller of claim 6, wherein the movement is a lever action.

12. The controller of claim 6, wherein the movement is rotation.

13. The controller of claim 6, wherein the controller is configured to at least one of:

(i) generate a fourth electronic window control signal to fully lower the power window upon crank rotation of the crank-handle body by a fourth predetermined amount in excess of the third predetermined amount in the second predetermined direction; and (ii) generate the third electronic window control signal a sufficient time to fully lower the power window upon crank rotation of the crank-handle body by the fourth predetermined amount in excess of the third predetermined amount in the second predetermined direction.

14. An automobile, comprising:

a power window actuator; and a controller according to claim 13, wherein the controller is in electrical communication with the power window actuator.

15. A controller for a power window actuator, comprising a crank-handle body;

an electronic control unit that includes at least one electrical switch positioned such that movement of the crank-handle body actuates the switch, wherein the electronic control unit is configured to generate a first electronic window control signal after the switch is actuated to at least one of a closed and an open position by movement of the crank-handle body; and a window selector configured to at least one of (i) direct the first electronic window control signal to one specific power window actuation device from amongst a plurality of specific power window actuation devices, and (ii) influence the generated first electronic window control signal so that the signal actuates the one specific power window actuation device from amongst the plurality of specific power window actuation devices.

16. The controller of claim 15, wherein the controller is configured to apply back lighting to the window selector.

17. A controller for a power window actuator, comprising:

a crank-handle body;

an electronic control unit that includes at least one electrical switch positioned such that movement of the crank-handle body actuates the switch, wherein the electronic control unit is configured to generate a first electronic window control signal after the switch is actuated to at least one of a closed and an open position by movement of the crank-handle body; and a window selector configured to at least one of (i) simultaneously direct the first electronic window control signal to a plurality of specific power window actuation device from amongst a plurality of specific power window actuation devices, and (ii) influence the generated first electronic window control signal so that the signal simultaneously actuates the plurality of specific power window actuation device from amongst the plurality of specific power window actuation devices.

18. A controller for a power window actuator, comprising:

a crank-handle body;

an electronic control unit that includes at least one electrical switch positioned such that movement of the crank-handle body actuates the switch, wherein the electronic control unit is configured to generate a first electronic window control signal after the switch is actuated to at least one of a closed and an open position by movement of the crank-handle body; and a window selector, wherein the window selector includes at least one touch switch, wherein the touch switch is configured to at least one of close and open a circuit upon a user touching the switch to at least one of (i) direct the first electronic window control signal to only one specific power window actuation device from amongst a plurality of specific power window actuation devices, and (ii) influence the generated first electronic window control signal so that the signal actuates only the one specific power window actuation device from amongst the plurality of specific power window actuation devices.

19. A controller for a power window actuator, comprising:

a crank-handle body;

an electronic control unit that includes at least one electrical switch positioned such that movement of the crank-handle body actuates the switch, wherein the electronic control unit is configured to generate a first electronic window control signal after the switch is actuated to at least one of a closed and an open position by movement of the crank-handle body; and a window selector, wherein the window selector includes a first touch switch and a second touch switch, wherein the first touch switch is configured to at least one of close and open a first respective circuit upon a user touching the first switch to at least one of (i) direct the first electronic window control signal to only a first specific power window actuation device from amongst a plurality of specific power window actuation devices, and (ii) influence the generated first electronic window control signal so that the signal actuates only the first specific power window actuation device from amongst the plurality of specific power window actuation devices, and the second touch switch is configured to at least one of close and open a second respective circuit upon the user touching the second switch to at least one of (i) direct a second electronic window control signal to only a second specific power window actuation device from amongst the plurality of specific power window actuation devices, and (ii) influence the generated first electronic window control signal so that the signal actuates only the second specific power window actuation device from amongst the plurality of specific power window actuation devices.

20. The controller of claim 19, wherein the window selector includes a third touch switch and a fourth touch switch, wherein the third touch switch is configured to at least one of close and open a third respective circuit upon the user touching the third switch to at least one of (i) direct a third electronic window control signal to only the third power window actuation device from amongst the plurality of specific power window actuation devices, and (ii) influence the generated first electronic window control signal so that the signal actuates only the third specific power window actuation device from amongst the plurality of specific power window actuation devices, and the fourth touch switch is configured to at least one of close and open a fourth respective circuit upon the user touching the fourth switch to at least one of (i) direct a fourth electronic window control signal to only a fourth specific power window actuation device from amongst the plurality of specific power window actuation devices, and (ii) influence the generated first electronic window control signal so that the signal actuates only the fourth specific power window actuation device from amongst the plurality of specific power window actuation devices.

21. The controller of claim 19, wherein the window selector is configured such that a user may simultaneously control actuation of a plurality of window actuation devices through a single movement of the crank-handle body.

22. A controller for a power window actuator, comprising:

a crank-handle body; and an electronic control unit that includes at least one electrical switch positioned such that movement of the crank-handle body actuates the switch, wherein the electronic control unit is configured to generate a first electronic window control signal after the switch is actuated to at least one of a closed and an open position by movement of the crank-handle body, and the crank handle is mounted in a bezel that substantially encompasses the crank-handle body.

23. A controller for a power window actuator, comprising:

a crank-handle body; and an electronic control unit that includes at least one electrical switch positioned such that movement of the crank-handle body actuates the switch, wherein the electronic control unit is configured to generate a first electronic window control signal after the switch is actuated to at least one of a closed and an open position by movement of the crank-handle body, and the controller is configured to apply back lighting to the crank handle body.

24. A method of controlling an automobile window by a user, comprising:

crank rotating a crank-handle body by gripping a crank handle grip in a palm of a hand of the user and applying a torque to the crank-handle body to actuate an electrical switch;

generating a first electronic window control signal after the switch is actuated to at least one of a closed and an open position by movement of the crank-handle body; and directing the first electronic window control signal to a power window actuator to raise the automobile window.

25. The method of claim 24, further comprising:

crank rotating the crank-handle by a first predetermined amount in a first direction to generate the first electronic window control signal to raise the power window.

26. The method of claim 25, further comprising:

crank rotating the crank-handle body in an opposite direction from the first predetermined direction by a second predetermined amount to at least one of (i) cease generating the first electronic window control signal, and (ii) generate a second electronic window control signal to stop the power window from raising.

27. The method of claim 26, further comprising:

crank rotating the crank-handle body to generate a third electronic window control signal to fully raise the automatic window by crank rotating the crank-handle body by a third predetermined amount in excess of the first predetermined amount in the first predetermined direction; and crank rotating the crank-handle body to generate the first electronic window control signal a sufficient time to fully raise the automatic window upon crank rotation of the crank-handle body by the third predetermined amount in excess of the first predetermined amount in the first predetermined direction.

28. A controller for a power window actuator, comprising:

a support;

a crank-handle body mounted on the support, the crank handle body being configured to crank rotate with respect to the support and including a main body from which a crank arm extends, and a crank handle grip located on the crank arm substantially opposite the crank body and extending substantially normal away from the crank arm, wherein the main body is volumetrically larger than the crank handle, and wherein the axis of rotation of the crank handle body with respect to crank rotation bisects the crank body; and an electronic control unit that includes a plurality of mechanically actuated electrical switches such that:

crank rotation of the crank-handle body by a first amount in a first direction actuates a first electrical switch to control a logic device to output a signal, the signal being to raise a power window;

crank rotation of the crank-handle body by a second amount in the first direction actuates a second electrical switch to control the logic device to output the signal, the signal being to raise the power window to its full extent;

crank rotation of the crank-handle body by a third amount in a direction opposite the first direction actuates a third electrical switch to control the logic device to output the signal, the signal being to lower the power window;

crank rotation of the crank-handle body by a fourth amount in a direction opposite the first direction actuates a fourth electrical switch to control the logic device to output the signal, the signal being to lower the power window to its full extent.

29. The controller of claim 28, further comprising:

a window selector configured to at least one of (i) direct the signal to one specific power window actuation device from amongst a plurality of specific power window actuation devices, and (ii) influence the signal so that the signal actuates the one specific power window actuation device from amongst the plurality of specific power window actuation devices.

* * * * *